US005475790A

United States Patent [19]

Nagasaki

[11] Patent Number: 5,475,790

[45] Date of Patent: Dec. 12, 1995

[54] METHOD AND ARRANGEMENT OF DETERMINING COEFFICIENTS FOR LINEAR PREDICTIVE CODING

[75] Inventor: Mayumi Nagasaki, Tokyo, Japan

[73] Assignee: NEC Corporation, Tokyo, Japan

[21] Appl. No.: 205,773

[22] Filed: Mar. 4, 1994

Related U.S. Application Data

[63] Continuation of Ser. No. 837,320, Feb. 19, 1992, abandoned.

[30] Foreign Application Priority Data

Feb. 19, 1991 [JP] Japan ..... 3-045465

[51] Int. Cl.[6] ..... G10L 9/00

[52] U.S. Cl. ..... 395/2.28

[58] Field of Search ..... 381/29–51; 395/2.1–2.39

[56] References Cited

U.S. PATENT DOCUMENTS

| | | | |
|---|---|---|---|
| 4,544,919 | 10/1985 | Gerson | 340/347 |
| 4,696,040 | 9/1987 | Doddington et al. | 381/46 |
| 5,068,597 | 11/1991 | Silverstein et al. | 364/485 |

OTHER PUBLICATIONS

Rialan C P et al., "Fixed–Point error analysis of the lattice and the Schur algorithms for the auto correlation method of linear prediction", IEEE Trans. ASSP, vol. 37, No. 12, pp. 1950–1957, Dec. 1989.

Rialan C P et al., "Fast algorithms for computing QR and Cholesky factors of Toeplitz operators," IEEE Trans. ASSP, vol. 36, No. 11, pp. 1740–1748, Nov. 1988.

*Primary Examiner*—Allen R. MacDonald
*Assistant Examiner*—Michelle Doerrler
*Attorney, Agent, or Firm*—Foley & Lardner

[57] ABSTRACT

In order to reduce the number of update operations for determining LPC (viz., reflection) data from an incoming sampled data, a plurality of matrices representative of auto-correlation functions are set in memory. Subsequently, data representative of the upper triangular portions of the matrices (virtual upper triangular matrices) are extracted from the memory and arranged into an array. This array is then updated using a j-th reflection coefficient, after which the value of j is incremented and the updating is repeated until a predetermined number of updating is completed.

2 Claims, 8 Drawing Sheets

FIG. 4A $$F = [f(i,k)] = \begin{pmatrix} f(0,0) & f(0,1) & \cdots\cdots & f(0,8) & f(0,9) \\ f(1,0) & f(1,1) & \cdots\cdots & f(1,8) & f(1,9) \\ & & \cdots\cdots & & \\ f(8,0) & f(8,1) & \cdots\cdots & f(8,8) & f(8,9) \\ f(9,0) & f(9,1) & \cdots\cdots & f(9,8) & f(9,9) \end{pmatrix}$$

FIG. 4B $$C = [c(i,k)] = \begin{pmatrix} c(0,0) & c(0,1) & \cdots\cdots & c(0,8) & c(0,9) \\ c(1,0) & c(1,1) & \cdots\cdots & c(1,8) & c(1,9) \\ & & \cdots\cdots & & \\ c(8,0) & c(8,1) & \cdots\cdots & c(8,8) & c(8,9) \\ c(9,0) & c(9,1) & \cdots\cdots & c(9,8) & c(9,9) \end{pmatrix}$$

FIG. 4C $$C_t = [c_t(i,k)] = \begin{pmatrix} c_t(0,0) & c_t(1,0) & \cdots\cdots & c_t(8,0) & c_t(9,0) \\ c_t(0,1) & c_t(1,1) & \cdots\cdots & c_t(8,1) & c_t(9,1) \\ & & \cdots\cdots & & \\ c_t(0,8) & c_t(1,8) & \cdots\cdots & c_t(8,8) & c_t(9,8) \\ c_t(0,9) & c_t(1,9) & \cdots\cdots & c_t(8,9) & c_t(9,9) \end{pmatrix}$$

FIG. 4D $$B = [b(i,k)] = \begin{pmatrix} b(0,0) & b(0,1) & \cdots\cdots & b(0,8) & b(0,9) \\ b(1,0) & b(1,1) & \cdots\cdots & b(1,8) & b(1,9) \\ & & \cdots\cdots & & \\ b(8,0) & b(8,1) & \cdots\cdots & b(8,8) & b(8,9) \\ b(9,0) & b(9,1) & \cdots\cdots & b(9,8) & b(9,9) \end{pmatrix}$$

FIG. 5A $$F' = [f'(i,k)] = \begin{pmatrix} f'(0,0) & f'(0,1) & \cdots & f'(0,8) & f'(0,9) \\ 0 & f'(1,1) & \cdots & f'(1,8) & f'(1,9) \\ & & \cdots & & \\ 0 & 0 & \cdots & f'(8,8) & f'(8,9) \\ 0 & 0 & \cdots & 0 & f'(9,9) \end{pmatrix}$$

FIG. 5B $$C' = [c'(i,k)] = \begin{pmatrix} c'(0,0) & c'(0,1) & \cdots & c'(0,8) & c'(0,9) \\ 0 & c'(1,1) & \cdots & c'(1,8) & c'(1,9) \\ & & \cdots & & \\ 0 & 0 & \cdots & c'(8,8) & c'(8,9) \\ 0 & 0 & \cdots & 0 & c'(9,9) \end{pmatrix}$$

FIG. 5C $$C'_t = [c'_t(i,k)] = \begin{pmatrix} c'_t(0,0) & c'_t(1,0) & \cdots & c'_t(8,0) & c'_t(9,0) \\ 0 & c'_t(1,1) & \cdots & c'_t(8,1) & c'_t(9,1) \\ & & \cdots & & \\ 0 & 0 & \cdots & c'_t(8,8) & c'_t(9,8) \\ 0 & 0 & \cdots & 0 & c'_t(9,9) \end{pmatrix}$$

FIG. 5D $$B' = [b'(i,k)] = \begin{pmatrix} b'(0,0) & b'(0,1) & \cdots & b'(0,8) & b'(0,9) \\ 0 & b'(1,1) & \cdots & b'(1,8) & b'(1,9) \\ & & \cdots & & \\ 0 & 0 & \cdots & b'(8,8) & b'(8,9) \\ 0 & 0 & \cdots & 0 & b'(9,9) \end{pmatrix}$$

FIG. 6

$$
\begin{pmatrix}
\begin{Bmatrix} f'(0,0) \\ c'(0,0) \\ c'_t(0,0) \\ b'(0,0) \end{Bmatrix} & \begin{Bmatrix} f'(0,1) \\ c'(0,1) \\ c'_t(0,1) \\ b'(0,1) \end{Bmatrix} & \cdots\cdots & \begin{Bmatrix} f'(0,8) \\ c'(0,8) \\ c'_t(0,8) \\ b'(0,8) \end{Bmatrix} & \begin{Bmatrix} f'(0,9) \\ c'(0,9) \\ c'_t(0,9) \\ b'(0,9) \end{Bmatrix} \\
0 & \begin{Bmatrix} f'(1,1) \\ c'(1,1) \\ c'_t(1,1) \\ b'(1,1) \end{Bmatrix} & \cdots\cdots & \cdots\cdots & \cdots\cdots \\
\vdots & \vdots & & & \\
0 & 0 & \cdots\cdots & \begin{Bmatrix} f'(8,8) \\ c'(8,8) \\ c'_t(8,8) \\ b'(8,8) \end{Bmatrix} & \begin{Bmatrix} f'(8,9) \\ c'(8,9) \\ c'_t(8,9) \\ b'(8,9) \end{Bmatrix} \\
0 & 0 & \cdots\cdots & 0 & \begin{Bmatrix} f'(9,9) \\ c'(9,9) \\ c'_t(9,9) \\ b'(9,9) \end{Bmatrix}
\end{pmatrix}
$$

FIG. 7

$f'(0,0) \longrightarrow t[0]$ $c'(0,0) \longrightarrow t[1]$ $c'_t(0,0) \longrightarrow t[2]$ $b'(0,0) \longrightarrow t[3]$ $f'(0,1) \longrightarrow t[4]$ $c'(0,1) \longrightarrow t[5]$ $c'_t(0,1) \longrightarrow t[6]$ $b'(0,1) \longrightarrow t[7]$ $\vdots \qquad \vdots \qquad \vdots$ $f'(8,9) \longrightarrow t[212]$ $c'(8,9) \longrightarrow t[213]$ $c'_t(8,9) \longrightarrow t[214]$ $b'(8,9) \longrightarrow t[215]$ $f'(9,9) \longrightarrow t[216]$ $c'(9,9) \longrightarrow t[217]$ $c'_t(9,9) \longrightarrow t[218]$ $b'(9,9) \longrightarrow t[219]$

FIG. 8

```
int   i, j, k, ii, kk;
double t [NN], r [Np] ;

ii=0;  kk=0;
for (i=0;i<=Np-j-1;i++)   {
          for (k=i;k<=Np-j-1;k++)   {
                  t [ii++]=t [kk]
          300 {             +r [j]*(t [kk+1]+t [kk+2])
                            +r [j]*r [j]*t [kk+3] ;
                  kk+=4;

                  t [ii++]=t [kk+1]
          301 {             +r [j]*(t [kk+3]+t [kk])
                            +r [j]*r [j]*t [kk+2] ;
                  kk+=4*(9-j-i) ;

                  if (i==k)   {
                            jj=ii;
                            t [ii++]=t [jj-1] ;
                  }
          302     else  {
                  t [ii++]=t [kk+2]
                            +r [j]*(t [kk+3]+t [kk])
                            +r [j]*r [j]*t [kk+1] ;
                  }
                  kk+=4;

                  t [ii++]=t [kk+3]
          303 {             +r [j]*(t [kk+1]+t [kk+2])
                            +r [j]*r [j]*t [kk] ;
                  kk+=4*(j+i-10) ;
          }
          kk+=4;
}
```

METHOD AND ARRANGEMENT OF DETERMINING COEFFICIENTS FOR LINEAR PREDICTIVE CODING

This application is a continuation of application Ser. No. 07/837,320, filed Feb. 19, 1992, now abandoned.

BACKGROUND OF THE INVENTION

1. Field of the Invention

The present invention relates generally to a method and arrangement for determining coefficients for linear predictive coding (LPC), and more specifically to such an arrangement and method by which the number of calculations for deriving LPC coefficients can be markedly reduced.

2. Description of the Prior Art

As is well known in the art, LPC is a method of analyzing a speech signal and characterizing that signal in terms of coefficients which can be encoded, received and decoded to reproduce a close approximation to the original signal. As one of the methods of analyzing a speech signal using the LPC, a covariance method has been disclosed in U.S. Pat. No. 4,544,919.

Before turning to the present invention it is deemed advantageous to briefly discuss the method for determining LPC coefficients which has been disclosed in the above-mentioned U.S. Patent.

Reference is made to FIG. 1, wherein there is shown a flowchart which characterizes the sequence of operations of the aforesaid prior art.

In FIG. 1, it is assumed that an original speech signal to be treated has been sampled or discreted. After start 10, autocorrelation coefficients are calculated from the sampled speech signal using the following autocorrelation function g(i,k) at step 12. The determination of the autocorrelation coefficients is well known in the art.

$$g(i,k) = \sum_{n=Np}^{N-1} s(n-1)s(n-k) \quad (1)$$

$$\text{for } 0 \leqq i \leqq Np \text{ and } 0 \leqq k \leqq Np$$

where s(n), $0 \leqq n \leqq N-1$ are samples of the speech signal during a frame, and Np is the order of reflection coefficients.

Merely for the sake of simplifying the discussions, it is assumed that the number of the samples within a frame is 160 (viz., s(0), s(1), s(2), . . ., s(159)) and Np equals 10. Accordingly, equation (1) is given by:

$$g(i,k) = \sum_{n=10}^{160-1} s(n-i)s(n-k) \quad (2)$$

Thus, $$g(0,0) = S(10)s(10) + s(11)s(11) + \ldots + s(159)s(159)$$

$$g(0,1) = s(10)s(9) + s(11)s(10) + \ldots + s(159)s(158)$$

$$\ldots$$

$$g(0,10) = s(10)s(0) + s(11)s(1) + \ldots + s(159)s(149)$$

$$\ldots$$

$$g(10,10) = s(0)s(0) + s(1)s(1) + \ldots + s(149)s(149)$$

In this instance, the number of elements (viz., g(i,k)) totals 121. The elements g(i,k) are represented in the form of matrix with 11-row and 11-column (viz., 11×11 matrix) as indicated below.

$$\begin{bmatrix} g(0,0) & g(0,1) & g(0,2) & \ldots & g(0,9) & g(0,10) \\ g(1,0) & g(1,1) & g(1,2) & \ldots & g(1,9) & g(1,10) \\ g(2,0) & g(2,1) & g(2,2) & \ldots & g(2,9) & g(2,10) \\ & & & \ldots & & \\ g(9,0) & g(9,1) & g(9,2) & \ldots & g(9,9) & g(9,10) \\ g(10,0) & g(10,1) & g(10,2) & \ldots & g(10,9) & g(10,10) \end{bmatrix}, \quad (2)'$$

At step 14, three types of arrays f, c and b are derived from the autocorrelation function g(i,k) using the following equations (3), (4) and (5).

$$f(i,k) = g(i,k) \quad (3)$$

$$\text{for } 0 \leqq i \leqq 9(= Np-1) \text{ and } 0 \leqq k \leqq 9(= Np-1)$$

$$c(i,k) = g(i,k+1) \quad (4)$$

$$\text{for } 0 \leqq i \leqq 9(= Np-1) \text{ and } 0 \leqq k \leqq 9(= Np-1)$$

$$b(i,k) = g(i+1,k+1) \quad (5)$$

$$\text{for } 0 \leqq i \leqq 9(= Np-1) \text{ and } 0 \leqq k \leqq 9(= Np-1)$$

It is understood that:

$$F = [f(i,k)] = \begin{bmatrix} f(0,0) & f(0,1) & \ldots & f(0,8) & f(0,9) \\ f(1,0) & f(1,1) & \ldots & f(1,8) & f(1,9) \\ & & \ldots & & \\ f(8,0) & f(8,1) & \ldots & f(8,8) & f(8,9) \\ f(9,0) & f(9,1) & \ldots & f(9,8) & f(9,9) \end{bmatrix} \quad (6)$$

$$C = [c(i,k)] = \begin{bmatrix} c(0,0) & c(0,1) & \ldots & c(0,8) & c(0,9) \\ c(1,0) & c(1,1) & \ldots & c(1,8) & c(1,9) \\ & & \ldots & & \\ c(8,0) & c(8,1) & \ldots & c(8,8) & c(8,9) \\ c(9,0) & c(9,1) & \ldots & c(9,8) & c(9,9) \end{bmatrix} \quad (7)$$

$$B = [b(i,k)] = \begin{bmatrix} b(0,0) & b(0,1) & \ldots & b(0,8) & b(0,9) \\ b(1,0) & b(1,1) & \ldots & b(1,8) & b(1,9) \\ & & \ldots & & \\ b(8,0) & b(8,1) & \ldots & b(8,8) & b(8,9) \\ b(9,0) & b(9,1) & \ldots & b(9,8) & b(9,9) \end{bmatrix} \quad (8)$$

Each of these three matrices F, C and B is 10×10 square matrix.

Following this, the value of j (where j indicates a reflection coefficient loop variable) is set to 1 (step 16) and, the j-th reflection coefficient r[j] is determined using conventional techniques.

At step 20, the value of j is checked to see if j=Np. In this instance the answer is "NO" and hence control goes to step 22 wherein the arrays f, c and b are updated.

The value of j is incremented at step 24 and, control goes back to step 18. These operations at steps 18, 20, 22 and 24 are repeated until j=Np. Since it has been assumed that Np=10, the number of the loop (steps 18→20→22→24→18) amounts to 9. Consequently, the number of the updating operations for determining LPC coefficients are:

| | |
|---|---|
| j = 1 | $3 \times 9^2 = 243$ |
| j = 2 | $3 \times 8^2 = 192$ |
| j = 3 | $3 \times 7^2 = 147$ |
| j = 4 | $3 \times 6^2 = 108$ |
| j = 5 | $3 \times 5^2 = 75$ |
| j = 6 | $3 \times 4^2 = 48$ |
| j = 7 | $3 \times 3^2 = 27$ |
| j = 8 | $3 \times 2^2 = 12$ |
| j = 9 | $3 \times 1^2 = 3$ |
| Total | 855 |

As discussed above, the above-mentioned known technique has encountered the drawback that a relatively large number of the update operations is required for determining the LPC coefficients. This means that such a large number of addressing operations must be carried out and results in the operation speed being undesirably slowed down.

SUMMARY OF THE INVENTION

It is therefore an object of the present invention to provide a method by which the number of update operations for determining LPC (viz., reflection) coefficients is markedly reduced.

Another object of the present invention is to provide an arrangement by which the number of update operations for determining LPC (viz., reflection) coefficients is markedly reduced.

Another object of the present invention is to provide an arrangement by which the number of update operations for determining LPC (viz., reflection) coefficients is markedly reduced.

One aspect of the present invention comes in a method of determining reflection coefficients using linear predictive coding wherein a plurality of autocorrelation coefficients are derived from an incoming sampled speech signal, the autocorrelation coefficients being utilized to produce elements of three types of matrices F, C and B which are memorized in a memory and by which said reflection coefficients are calculated, said method comprising the steps of: (a) selectively retrieving, from said memory, elements to be included in three upper triangular matrices F', C' and B' of said matrices F, C and B, respectively, and retrieving, from said memory, elements to be included in an upper triangular matrix $C'_t$ of a transposed matrix $C_t$ of said matrix C; (b) arranging the elements retrieved in step (a) into an array; (c) calculating a j-th (j is a positive integer) reflection coefficient using said array; (d) updating the element values in said array according to the reflection coefficient calculated in step (c); and (e) incrementing the value of j and repeating steps (c) and (d) until a predetermined number of updating is completed.

Another aspect of the present invention comes in an apparatus for determining reflection coefficients using linear predictive coding wherein a plurality of autocorrelation coefficients are derived from an incoming sampled speech signal, the autocorrelation coefficients being utilized to produce elements of three types of matrices F, C and B which are memorized in a memory and by which said reflection coefficients are calculated, said apparatus comprising: means for selectively retrieving, from said memory, elements which are included in three upper triangular matrix portions F', C' and B' of said matrices F, C and B, respectively, and retrieving, from said memory, elements which are included in an upper triangular matrix portion $C'_t$ of a transposed matrix $C_t$ of said matrix C; means for arranging the retrieved elements into an array; means for calculating a j-th (j is a positive integer) reflection coefficient using said array; and means for updating the element values in said array according to the calculated reflection coefficient.

BRIEF DESCRIPTION OF THE DRAWINGS

The features and advantages of the present invention will become more clearly appreciated from the following description taken in conjunction with the accompanying drawings in which like elements are denoted by like reference numerals and in which:

FIGS. 4A–4D, 5A–5D and 6 depict the matrices which are involved in the implementation of the instant invention;

FIG. 7 depicts the amount of matrix elements which are set in memory in accordance with the technique which characterizes the present invention; and FIG. 8 depicts a C language program which can be used implementing the updating operation depicted in FIG. 2.

DETAILED DESCRIPTION OF THE PREFERRED EMBODIMENTS

One embodiment of the present invention will be discussed with reference to FIGS. 2–8.

Figure 1:
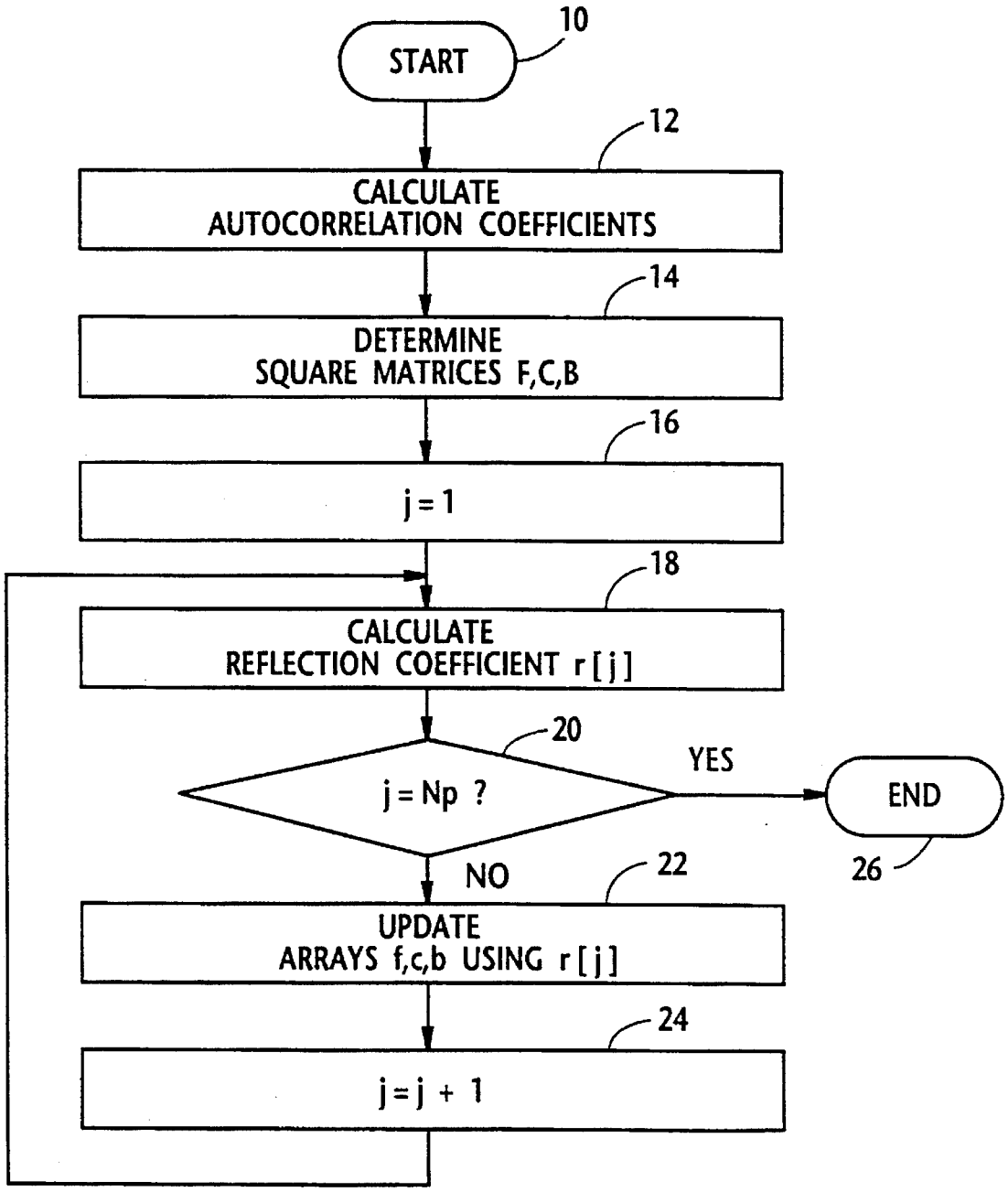
FIG. 1 (PRIOR ART)
FIG. 1 is a flowchart which characterizes the operations of the known technique discussed in the opening paragraphs of the instant disclosure.
Figure 2:
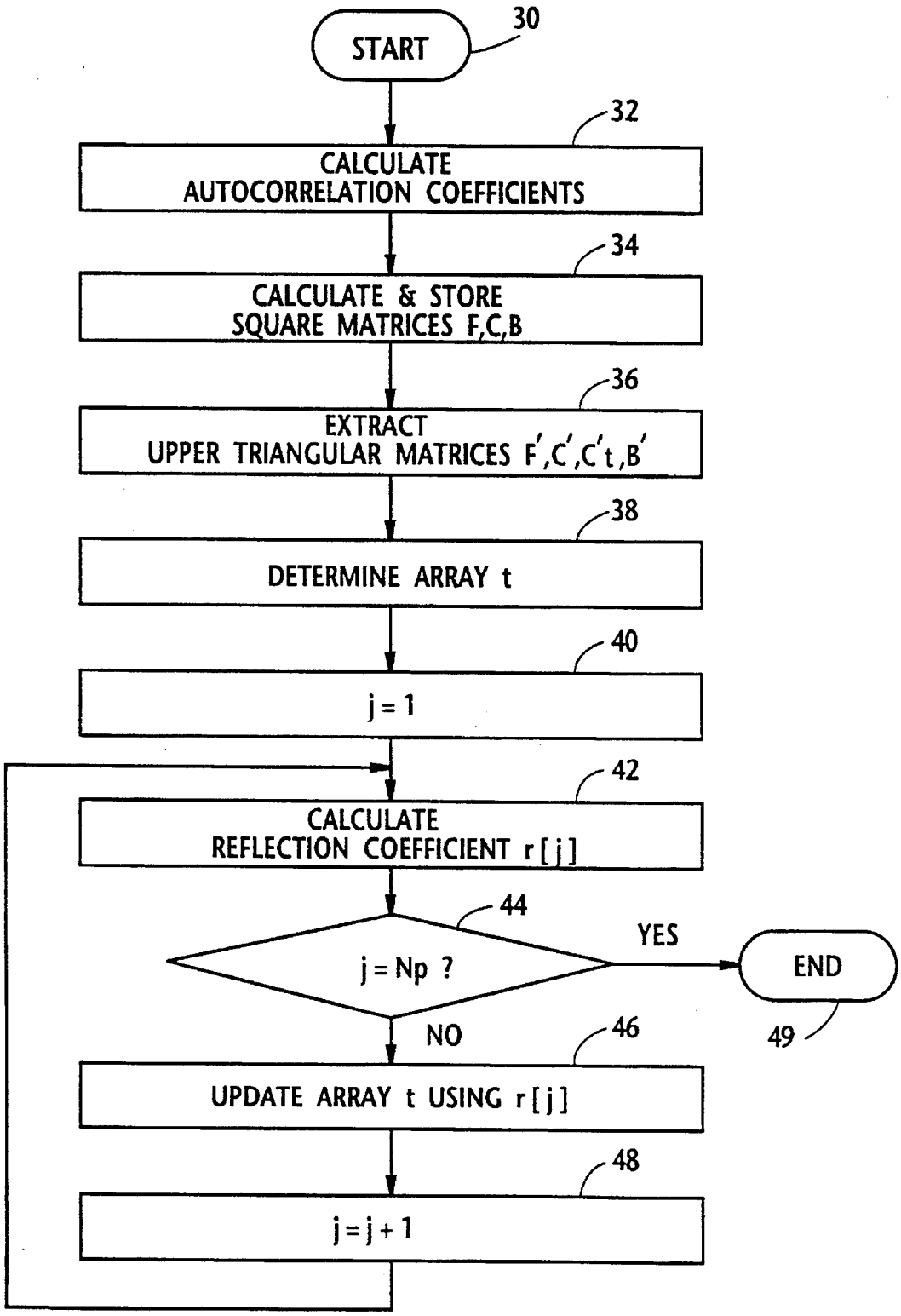
FIG. 2 is a flowchart which characterizes the operations of an embodiment of the present invention.

The flowchart shown in FIG. 2 includes additional steps 36, 38 as compared with that of FIG. 1. Further, operations at steps 42, 46 in FIG. 2 differ from the corresponding operations at steps 18, 22 of FIG. 1. The operations at the remaining steps 30, 32, 34, 40, 44, 48 and 49 of FIG. 2 are respectively similar (essentially) to steps 10, 12, 14, 16, 20, 24 and 26 of FIG. 1.

Figure 3:
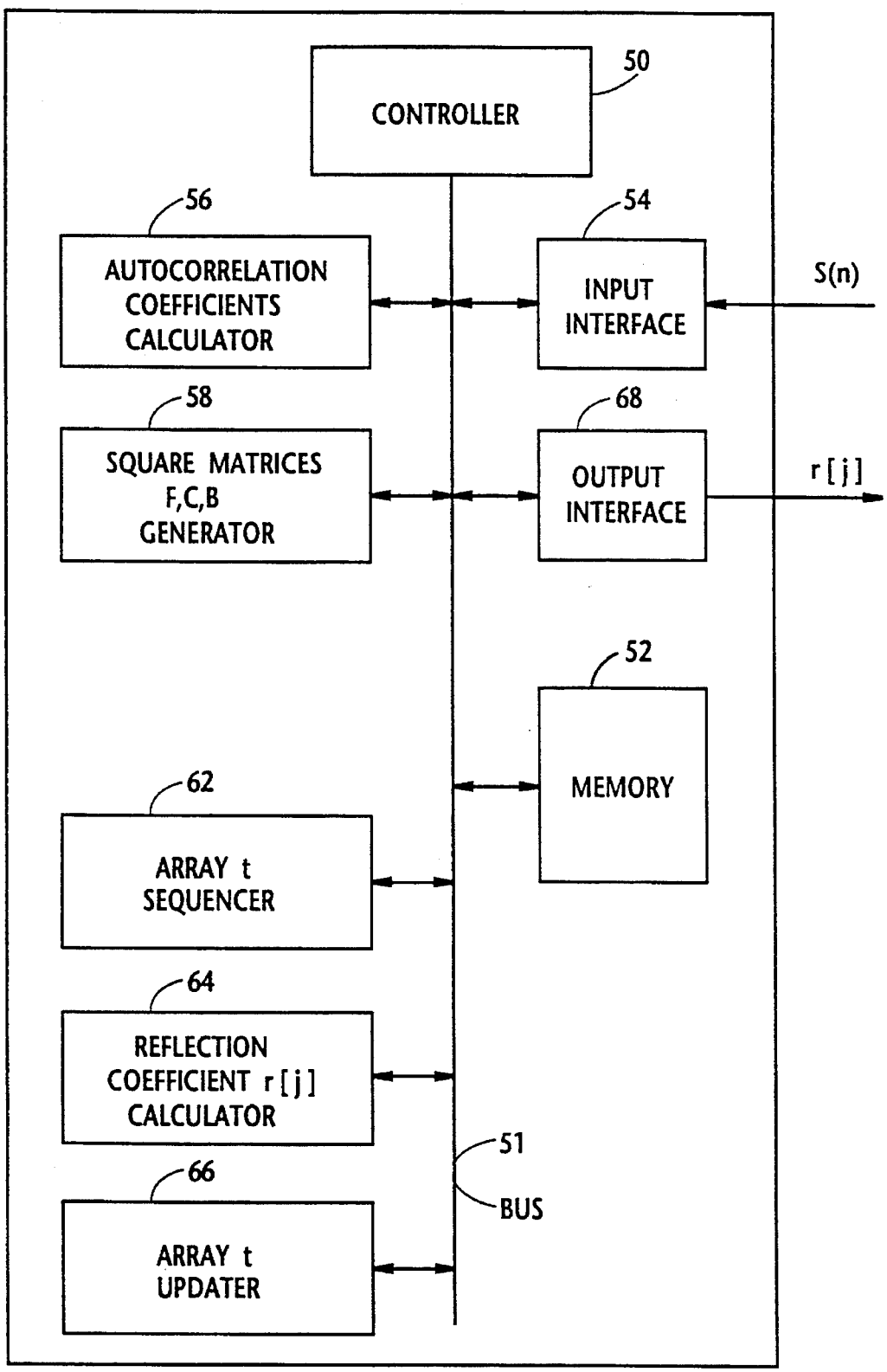
FIG. 3 is a block diagram showing an arrangement for implementing the operations discussed with the FIG. 2 flowchart.

FIG. 3 is a highly schematic illustration of an arrangement via which the invention can be implemented. In this figure, a controller 50 is provided to manage the overall operations of the arrangement illustrated via a bus 51. A sampled or descreted speech signal S(n) is applied to a memory 52 via an input interface 54. As in the discussion in the opening paragraphs, it is assumed that the number of samples within one frame is 160 (viz., S(0), s(1), S(2), . . . , s(158) and s(159)). These sampled values s(0)–s(159) are stored in suitable storage locations of the memory 52. Following this, the autocorrelation coefficients are calculated using the function g(i,k) given by equation (2), at a calculator block 56 of FIG. 3 (step 32 of FIG. 2). The autocorrelation coefficients thus determined, are stored in the memory 52.

Subsequently, a square matrix generator 58 determines the elements of the above-mentioned Np×Np square matrices F, C and B using the autocorrelation coefficients stored in the memory 52 (step 34 of FIG. 2).

The operations at steps 32, 34 have been described in connection with the prior art.

FIGS. 4A, 4B and 4D show the above-mentioned matrices F, C and B for the convenience of description. It will be noted that FIG. 4C shows a transposed matrix $C_t$ of the matrix C. The elements of the matrix are also stored in memory 52 in this instance.

In accordance with the present invention, data, each of which is included in the upper portion of the virtual upper triangular matrices F', C' and B', is extracted from the matrices F, C and B, respectively. In addition, the elements or data, which correspond to the upper portion of another upper triangular matrix $C'_t$, is extracted from the transposed matrix $C_t$. It is understood that this extraction can actually be executed by determining if $i \leqq k$ for the data of the matrices F, C, $C_t$ and B.

The extracted data is depicted as the element which is included in the upper portion (enclosed by solid line) of each of the virtual upper triangular matrices F', C', $C'_t$ and B' in FIGS. 5A–5D. As will be fully appreciated these matrices are not actually compiled in the illustrated manner and are illustrated merely for the sake of easy comprehension.

An array t sequencer 62 groups the elemental data which correspond to the upper portion elements of the four virtual upper triangular matrices F', C', $C'_t$ and B'. This grouping is depicted in FIG. 6. Viz., this process groups matrix elements with i row indicator having the same value and arranges the same according to ascending value of k column indicator. In the case wherein i and k are both the same, the grouping is made in the order of f', c' $c'_t$ and b'.

The results of this grouping are then set in the memory 52 in the manner that the above-mentioned data corresponding to the elements of the upper triangular matrices F', C', $C'_t$ and B' are respectively assigned to or specified by t[0]–t[219] as shown in FIG. 7.

Following this, the value of j is set to 1 (step 40 of FIG. 2) and then the j-th reflection coefficient r[j] is determined using the following equation (9) at a reflection coefficient calculator 64 (step 42 of FIG. 2).

$$r(j) = \frac{\{-2\{t[1] + t[J+1]\}\}}{\{t[0] + t[3] + t[J] + t[J+3]\}} \tag{9}$$

where $$J = 4 \sum_{n=2}^{Np-j+1} n \quad (1 \leqq j \leqq Np-1)$$

$$J = 0 \quad (j = Np)$$

At step 44, the value of j is checked to see if j=Np. In this instance the answer is "NO" and hence control goes to step 46 wherein the array f, c and b are updated.

More specifically, the update operation (step 46) in this embodiment is executed at an array t updater 66. Merely by way of example, FIG. 8 shows the program for the update operations written by the C language wherein i and k denote the row/column indicators (i,k) of the Np×Np upper triangular matrix, j is the reflection coefficient loop variable, kk is the suffix of the current array t, and ii is the suffix of new array t. At stage 300 of this program the f'(i,k) are updated, at 301 c'(i,k) are updated, while at 302 $c'_t$(i,k) are updated and at 303 b' (i, k) are updated. This program performs a double loop and updates all of the matrix elements f'(k,i), c'(i,k), $c'_t$(i,k) & b'(i,k). The updating itself is not directly concerned with the present invention and hence the further discussions thereof will be omitted.

Following the completion of the instant updating operation, j is incremented at step 48 whereafter the routine loops back to step 42. Upon j becoming equal to Np the routine goes to end (step 49).

Following the end of the routine illustrated in FIG. 2, the updated data is set in memory ready to be retrieved under the control of the controller 50 and is outputted via an output interface 68.

The effect of the above is such that, as different from the above discussed prior art arrangement wherein the update is executed directly from the square matrices F, C, B, the array t is updated based on data representative of the upper elements of the four types of upper triangular matrices F', C' $C'_t$ and B' whereby:

(1) the number of the updating operations for determining LPC coefficients are:

| | |
|---|---|
| j = 1 | 4 × 45 = 180 |
| j = 2 | 4 × 36 = 144 |
| j = 3 | 4 × 28 = 112 |
| j = 4 | 4 × 21 = 84 |
| j = 5 | 4 × 15 = 60 |
| j = 6 | 4 × 10 = 40 |
| j = 7 | 4 × 6 = 24 |
| j = 8 | 4 × 3 = 12 |
| j = 9 | 4 × 1 = 4 |
| Total | 660 |

As will be appreciated this amounts to a marked reduction in the number of updating operations which are performed to produce the reflection coefficients.

A further advantage comes in that the data arranged along with the array t are updated sequentially and thus simplifies the memory addressing as compared with the above discussed prior art.

While the foregoing description describes one preferred embodiment of present invention, the various alternatives and modifications possible without departing from the scope of the present invention, which is limited only by the appended claims, will be apparent to those skilled in the art.

What is claimed is:

1. An apparatus for processing speech signals to obtain reflection coefficients using linear predictive coding, said apparatus comprising:

means for receiving a speech signal representative of speech;

means for sampling said speech signal into frames of sample values of said speech signal;

a bus for transmitting information between various elements of said apparatus;

a memory connected to said bus;

an input interface connected to said bus, said input interface receiving said frames of sample values of said speech signal, said frames of sample values being stored in said memory;

a first calculating means connected to said bus for calculating a plurality of autocorrelation coefficients g(i,k) derived from said frames of sample values according to the relationship.

$$g(i,k) = \sum_{n=Np}^{N-1} s(n-1)s(n-k)$$

for $0 \leqq i \leqq Np$ and $0 \leqq k \leqq Np$, where s(n), $0 \leqq n \leqq N-1$ are a number of sample values in said frames of sample values and Np is the order of reflection coefficients, said autocorrelation coefficients g(i,k) being stored in said memory;

a square matrix generator connected to said bus, said generator receiving said autocorrelation coefficients from said memory and generating elements of three types of matrices F, C and B according to the relationships $$F = \{f(i,k)\} = \{g(i,k)\}$$

$$\text{for } 0 \leqq i \leqq Np - 1 \text{ and } 0 \leqq k \leqq Np - 1$$

$$C = \{c(i,k)\} = \{g(i,k+1)\}$$

$$\text{for } 0 \leqq i \leqq Np - 1 \text{ and } 0 \leqq k \leqq Np - 1$$

$$B = \{b(i,k)\} = \{g(i+1,k+1)\}$$

$$\text{for } 0 \leqq i \leqq Np - 1 \text{ and } 0 \leqq k \leqq Np - 1,$$

said elements being stored in said memory;

a controller, said controller retrieving from said memory, first i≦k matrix elements in each of said matrices F, C and B, and second i≦k matrix elements in a transposed matrix $C_t$ of said matrix C;

an array sequencer, said array sequencer grouping said first and second i≦k matrix elements according to an i row indicator and arranging said grouped first and second i≦k matrix elements according to an ascending order of k column indicators into an array, said array being stored in said memory;

a second calculating means connected to said bus and receiving said grouped first and second i≦k matrix elements in said array from said memory for calculating a jth reflection coefficient (where j is a positive integer between 1 and N); and an array updating means for updating said matrix elements in said array by storing said reflection coefficient in said memory at a location corresponding to said array;

incrementing means, included in said second calculating means, for incrementing a value of j used as said jth reflection coefficient until j=N; and output means for outputting a signal representative of said reflection coefficients, wherein said reflection coefficients are representative of the speech signal.

2. A method for processing a speech signal to obtain reflection coefficients using linear predictive coding in a processing apparatus including a controller, a memory, an input interface, and a bus said method comprising the steps of:

(a) receiving said speech signal representative of speech;

(b) sampling said speech signal to produce a sampled speech signal s(n), where 0≦N≦N−1;

(c) receiving via said input interface said sampled speech signal s(n) during a frame;

(d) storing said sampled speech signal into said memory;

(e) calculating a plurality of autocorrelation coefficients g(i,k) from said sampled speech signal s(n), according to the relationship $$g(i,k) = \sum_{n=Np}^{N-1} s(n-1)s(n-k)$$

$$\text{for } 0 \leqq i \leqq Np \text{ and } 0 \leqq k \leqq Np$$

where Np is the order of reflection coefficients;

(f) storing said autocorrelation coefficients g(i,k) in said memory;

(g) generating elements of three types of matrices F, C and B utilizing said autocorrelation coefficients, said matrices F, C and B being determined according to the relationships $$F = \{f(i,k)\} = \{g(i,k)\}$$

$$\text{for } 0 \leqq i \leqq Np - 1 \text{ and } 0 \leqq k \leqq Np - 1$$

$$C = \{c(i,k)\} = \{g(i,k+1)\}$$

$$\text{for } 0 \leqq i \leqq Np - 1 \text{ and } 0 \leqq k \leqq Np - 1$$

$$B = \{b(i,k)\} = \{g(i+1,k+1)\}$$

$$\text{for } 0 \leqq i \leqq Np - 1 \text{ and } 0 \leqq k \leqq Np - 1;$$

(h) storing said elements in said memory;

(i) retrieving from said memory, via said bus, under control of said controller, first i≦k matrix elements in each of said matrices F, C and B, and second i≦k matrix elements representing a transposed matrix $C_t$ of said matrix C;

(j) sequencing said first and second i≦k matrix elements into groups according to an i row indicator, said groups being arranged into an array according to an ascending order of k column indicators;

(k) storing said array in said memory;

(l) retrieving said first and second i≦k matrix elements from said array via said bus and calculating a jth reflection coefficient using said first and second i≦k matrix elements in said array, j being a positive integer between 1 and N;

(m) updating said matrix elements in said array by storing said jth reflection coefficient calculated in step (l) in said memory via said bus at a location in said memory corresponding to said matrix elements in said array;

(n) incrementing a value of j and repeating steps (l) through (n) until j=N; and (o) outputting said reflection coefficients;

(p) characterizing the speech signal based on the reflection signal.

* * * * *